United States Patent [19]

Dohse et al.

[11] 4,446,957

[45] May 8, 1984

[54] COIN OPERATED ARTICLE DISPENSING MECHANISM

[75] Inventors: Jerry L. Dohse, Alsip; Peter A. Hess, Chicago, both of Ill.

[73] Assignee: Damon Corporation, Needham Heights, Mass.

[21] Appl. No.: 343,427

[22] Filed: Jan. 28, 1982

[51] Int. Cl.³ ..... G07F 5/02

[52] U.S. Cl. ..... 194/54; 221/155

[58] Field of Search ..... 194/54, 55, 57, 75, 194/79, 37, 39; 221/155; 194/68, 63

[56] References Cited

U.S. PATENT DOCUMENTS

| | | | |
|---|---|---|---|
| 1,664,286 | 3/1928 | Dishman | 194/37 |
| 3,077,254 | 2/1963 | Goldfarb | 221/155 X |
| 3,937,314 | 2/1976 | Rosenberg et al. | 194/63 |

*Primary Examiner*—Stanley H. Tollberg

*Attorney, Agent, or Firm*—Lahive & Cockfield

[57] ABSTRACT

A coin operated gumball dispensing slide mechanism is disclosed which has a coin slide slidable over a base plate. The coin slide has a gumball dispensing wall, an aperture for passage of a gumball from a reservoir to the gumball dispensing wall, an actuator for moving the coil slide, a shoulder, and a portion defining a coin receiving slot. The coin slide is slidably mounted on a base plate which has a flexibly mounted locking dog for abutting the shoulder and locking the coin slide until a coin inserted into the slot disables the dog. When the coin is in the slot, moving the actuator moves the slide and the gumball is dispensed while the shoulder pushes the coin to a coin receiving aperture in the base plate and while a gate portion of the base plate intrudes on the gumball aperture to prevent gumballs from entering it during operation of the slide.

6 Claims, 11 Drawing Figures

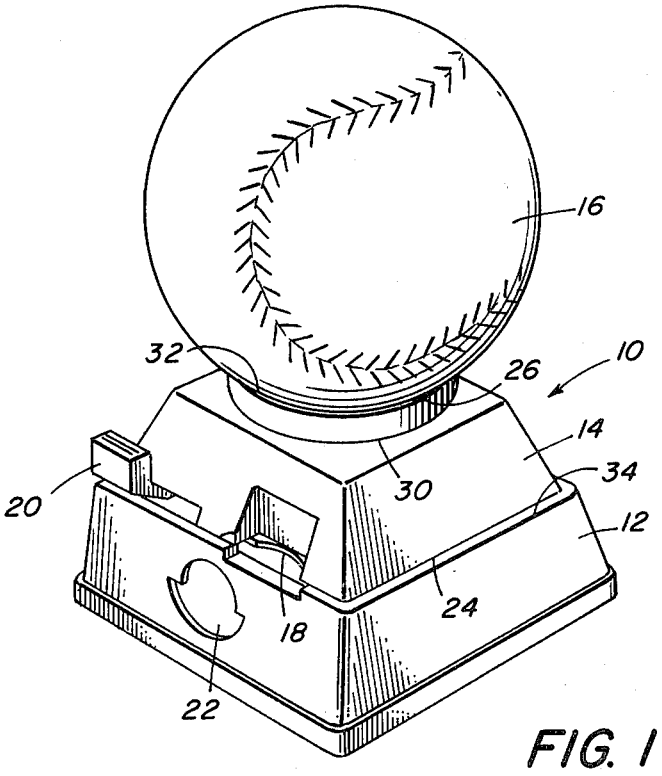
FIG. 1
FIG. 2
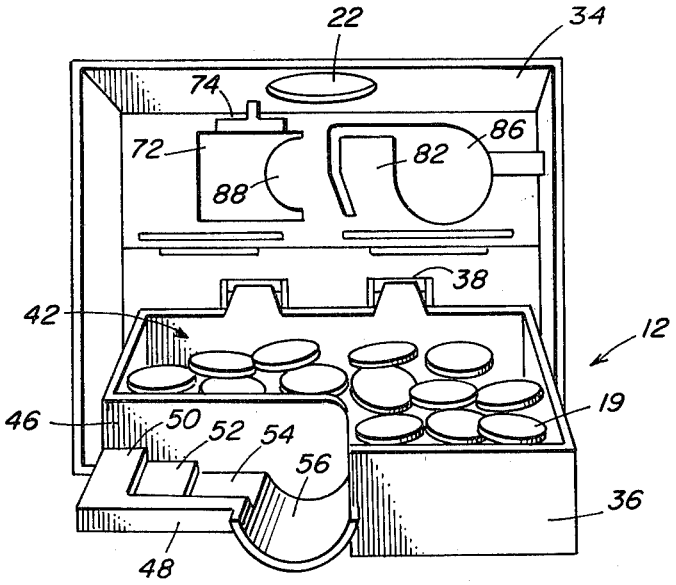

COIN OPERATED ARTICLE DISPENSING MECHANISM

BACKGROUND

This invention relates to coin operated article dispensing mechanisms, particularly to those used in gumball banks and the like.

Coin operated gumball dispensers have proven to be popular items when adapted for home use. In the home the gumball machines serve as banks; the coins collected by the machine are kept in a coin receptacle until the receptacle is opened and the coins are retrieved. One such gumball bank is described in U.S. Pat. No. 3,937,314 to Rosenberg and Keces.

Many of the characteristics of commercial coin-operated vending machines, such as security against tampering, vandalism and theft are unnecessary in home gumball banks. Rather, home gumball banks require ease of disassembly, simple operation and low cost.

Accordingly, it is an object of this invention to provide a coin operated article dispensing mechanism that is inexpensive to manufacture, and simple and reliable in use.

SUMMARY OF THE INVENTION

The invention provides, in a coin operated article dispensing device having a base means including article access means, and reservoir means for holding a plurality of articles to be dispensed, mounted on the base means, a coin operated mechanism that comprises a base plate means forming a portion of the base means and a slide plate means slidably mounted on the base plate means and slidable between a first, locked, position and a second, dispensing, position. The slide plate means includes article dispensing means for dispensing articles when the plate means is moved from its first to its second position, means defining an article aperture for passage of articles from the reservoir means to the article dispensing means, a first coin slot portion defining a coin receiving slot, including a shoulder portion, and actuator means for slidably moving the slide plate. The base plate means includes a second coin slot portion defining a coin receiving slot, including a dog means flexibly mounted on the base plate means and arranged to abut the shoulder portion in the absence of a coin in the slot and to be moved from the abutting position by the presence of a coin in the slot.

Preferably, the base plate means includes a gate portion adapted to intrude in the article aperture when the slide plate is moved from the first to the second position, and the shoulder portion includes a coin moving portion, the base plate means including a portion defining a coin aperture for receiving coins moved by the coin moving portion. Also, the article dispensing means comprises wall means mounted on the slide plate means and a wall portion of the base means is arranged to cooperate with the wall means to store an article when the slide plate means is in the first position.

BRIEF DESCRIPTION OF THE DRAWINGS

Other objects, features and advantages of the invention will be listed in, or inherently appear in, the following description of a preferred embodiment of the invention, including the drawing thereof, in which:

FIG. 1 is a perspective view of a gumball bank;

FIG. 2 is a view of the base opened to reveal the coin tray;

DESCRIPTION OF A PREFERRED EMBODIMENT

Figure 3:
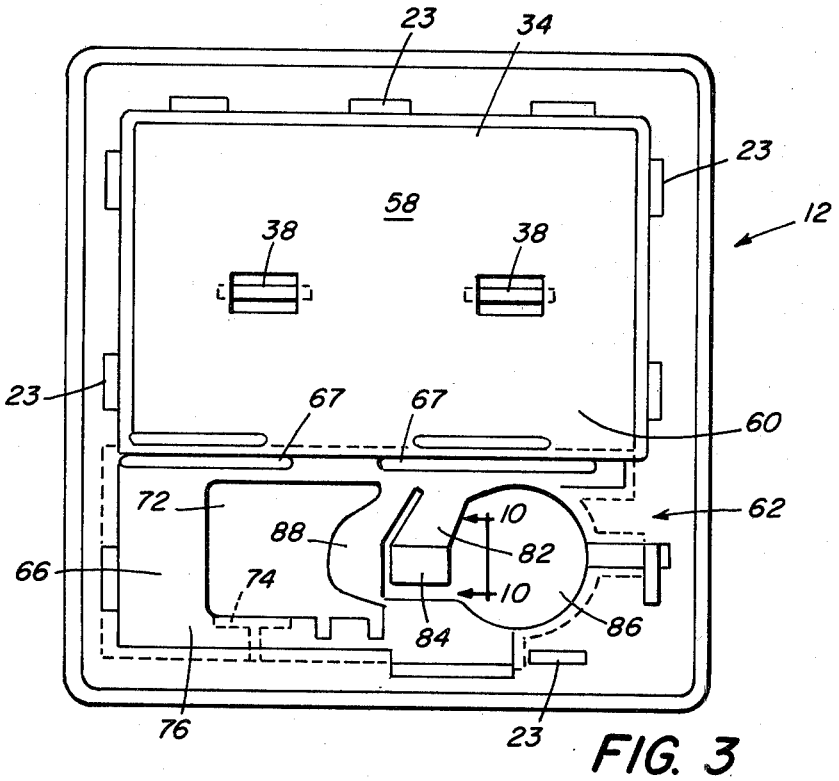
FIG. 3 is a plan view of the upper base.

Referring to the drawings, there is shown in FIG. 1 a gumball dispensing bank 10 that includes a base 12, a reservoir 14 mounted above the base 12, and a globe 16 mounted above the reservoir 14.

The gumball bank base 12 is made of opaque plastic and includes a coin receiving slot 18 for receiving a coin 19, an actuator 20 that may be moved when a coin is in the slot 18, and a gumball access hole 22 through which a gumball 21 dispensed by the bank may be reached. The reservoir 14 is made of clear plastic, so that gumballs 21 inside may be seen, and is snap-fit by means of tabs (not shown) into slots 23 on the top of the base 12.

Both the bottom 24 and the top 26 of the reservoir 14 are open. The bottom 24 of the reservoir is open so that gumballs 21 in the reservoir 14 are free to move about atop the base 12. The top 26 of the reservoir 14 is open and has a threaded collar 30 to which the globe 16 may be threadedly attached. The globe 16, of clear or opaque plastic, has an open bottom 32, so that gumballs 21 put in the globe 16 fall freely into the reservoir 14. The gumball bank 10 is filled and refilled by unscrewing the globe 16, filling it with gumballs 21, screwing it back onto the reservoir collar 30 while the bank 10 is in the upside down position, then turning the bank right side up so that gumballs 21 fill the reservoir 14.

Figure 4:
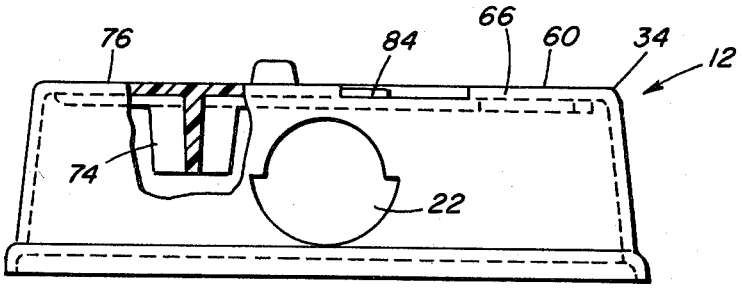
FIG. 4 is a front elevation view of the upper base.

The base 12 of the bank (see FIGS. 2–4) has an upper base 34 and a lower base 36 hinged together by hinges 38 so that the upper base 34 and the lower base 36 may be spread apart (see FIG. 2). The upper base 34 (FIGS. 3 and 4) bears the coin-operated mechanism 40 of the bank 10. The lower base 36 includes a coin tray 42 for receiving coins 19 inserted into the bank 10. The upper and lower bases 34 and 36 are ordinarily snapped in a closed position by tabs not shown in the drawing and may be opened by pressure applied at a certain point—as by the finger pressing on the lower base 36 through the gumball access hole 22 in the upper base 34.

The lower base 36 of the base 12 furthermore has a front indented wall 46 from the front of which projects a gumball ramp 48. The ramp 48 has a series of steps descending from a first step 50 at the corner of the wall 46, through two more steps 52, 54, to a gumball trough 56. The gumball trough 56 is located immediately behind the gumball access hole 22 when the upper and lower bases 34, 36 are closed, so that a gumball 21 that reaches the trough 56 is accessible through the gumball hole 22. The top 58 of the upper base 34 forms a floor 60 for the gumballs 21 stored in the reservoir 14. The front 62 of the top 58 is where the coin-operated article dispensing mechanism 40 (see FIGS. 7–9) is located.

Figure 5:
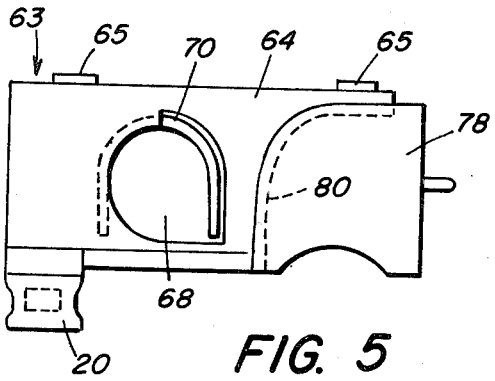
FIG. 5 is a plan view of the coin slide.
Figure 6:
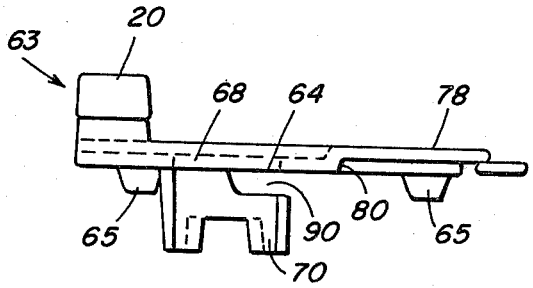
FIG. 6 is a front elevation view of the coin slide.

The coin-operated article dispensing mechansim 40 includes an upper, horizontal coin slide 63 (see FIGS. 5–6) with a generally planar, slide plate 64, and a lower, horizontal, generally planar, base plate 66. The base plate 66 forms part of the upper base 34 (see FIGS. 3 and 4). The coin slide 63 is mounted by way of cooperating tabs 65 and slots 67, on the base plate 66 so that it is horizontally slidable from left to right, and back again, on the base plate 66.

The coin slide (FIGS. 5 and 6) has the actuator 20 fixed to it. The actuator 20 must be moved (in the drawings, from left to right) to operate the mechanism 40 and dispense a gumball 21. The coin slide 63 defines a gumball aperture 68, defining an opening, in effect, in the floor of the gumball reservoir 14 through which gumballs 21 may pass to a semicircular gumball dispensing wall 70 extending downwardly from the coin slide plate 64. The base plate 66 has a corresponding aperture 72 arranged to be beneath the gumball aperture 68 of the coin slide 63 when the coin slide is in its leftmost position. When the coin slide 63 is in its leftmost, or first, locked position (with no coin inserted in the coin slot 18), a gumball storage wall 74 extending downwardly from the horizontal portion 76 of the base plate 66, and the second step 52 of the gumball ramp 48 cooperate with the gumball dispensing wall 70 to keep a gumball 21 in place, in a ready position for operation of the device. More gumballs 21 in the reservoir 14 above, of course, cannot enter the ready position through the gumball aperture 68 at this time because a gumball 21 is already present there. The coin slide 63 also has a horizontally extending upper coin slot wall 78, vertically displaced from the plate 64 by a vertical wall locking shoulder 80.

Figure 10:
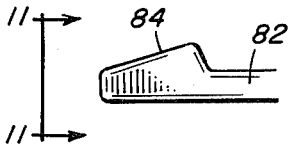
FIG. 10 is a side elevation view of the locking dog.
Figure 11:
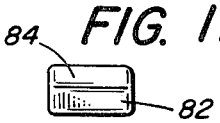
FIG. 11 is a front elevation view of the locking dog.

The base plate 66 includes a generally horizontally extending dog element 82 (see FIG. 3) that is positioned below the upper coin slot wall 78 of the coin slide 63 when the coin slide 63 is in its first position (see FIG. 7). The dog 82 is flexibly mounted with a rearwardly rising locking portion 84 (see FIGS. 10 and 11) extending into the coin slot 18 when no coin 44 is present. The locking portion 84 of the dog 82 abuts the coin slot shoulder 80 of the coin slide 63 in the absence of a coin, to prevent the movement of the coin slide away from its first, locked position (see FIG. 7). The insertion of a coin 19 into the coin slot 18 disables the locking function of the dog 82 by forcing down the locking portion 84 below the level of the shoulder 80 so that the coin slide 63 can be moved by the actuator 20.

The base plate 66 further includes a coin release aperture 86 horizontally rightwardly displaced from the coin slot 18, so that coins 19 may be pushed along by the coin slide shoulder 80 as the actuator 20 moves the coin slide 63 and fall through the aperture 86 into the coin tray 42 below.

Figure 7:
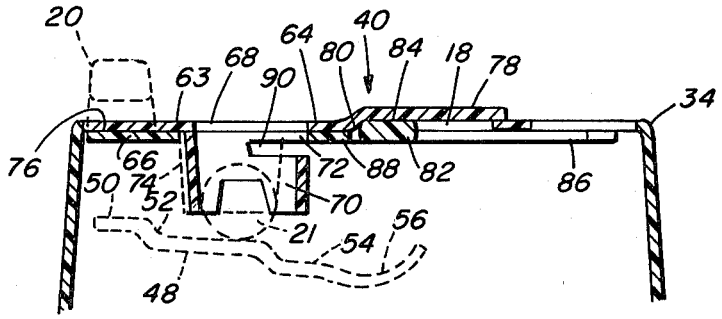
FIG. 7 is a sectional view of the coin slide and the base plate in which the coin slide is in its first, locked, position.
Figure 8:
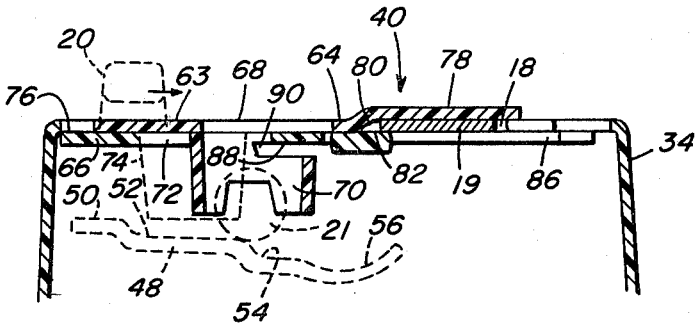
FIG. 8 is a view like FIG. 7 in which the coin slide is moved partially away from its first, locked, position.
Figure 9:
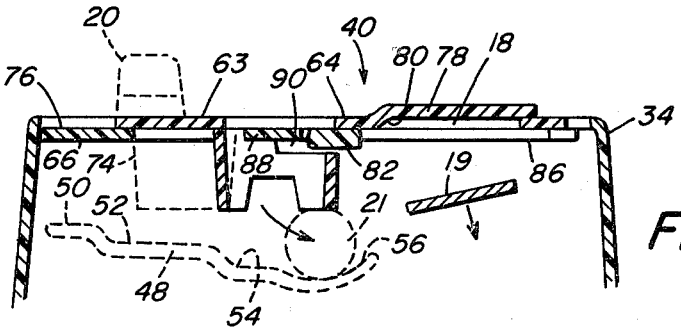
FIG. 9 is a view like FIG. 7 in which the coin slide is in its second, dispensing, position.

The base plate 66 also includes a horizontal gate 88 arranged to not interfere with the gumball aperture 68 when the coin slide 68 is in its first position (see FIG. 7), but that does pass through a cooperating slot 90 on the right side of the gumball dispensing wall 70 to intrude in the gumball aperture 68 when the coin slide 63 is moved from its first position (see FIGS. 8 and 9). When the gate 88 intrudes the aperture 68, gumballs 21 in the reservoir 14 are temporarily foreclosed from passing through the gumball aperture 68.

Furthermore, when the coin slide 63 moves to the right, the movement of the gumball dispensing wall 70, extending down from the slide plate 64, moves the gumball 21 away from the restriction of the fixed gumball storage wall 74, and down steps 52, 54 of the ramp 48 to the gumball trough 56, where the gumball is accessible through the gumball access hole 22.

To use the bank 10, it is first filled (or refilled) with gumballs 21 by unscrewing the globe 16 from the reservoir collar 30 (upside down if any gumballs are still present in the globe 16), adding gumballs to the globe 16 through the open globe bottom 32, and screwing the globe 16 back onto the reservoir collar 30.

The operation of the coin operated gumball dispensing mechanism 40 may be seen by referring to FIGS. 7, 8 and 9. Without any coin 19 in the coin slot 28, the coin slide 63 is locked into its first, locked, position (FIG. 7) and will not respond to any attempt to move it by the actuator 20, because the locking portion 84 of the dog 82 abuts the shoulder 80 of the coin slide 63 and prevents rightward movement. A gumball 21 is free to pass through the gumball aperture 68 in the coin slide 63 and the aperture 72 in the base plate 66 to be held in a ready position by the combination of gumball dispensing wall 70, storage wall 74 and the second step 52 of the gumball ramp 48, unless another gumball is already in the ready position there.

When a coin 19 is inserted into the coin slot 18 it disables the locking dog 82 by pressing the locking portion 84 down to below the level of the coin slide shoulder 80. Then, moving the actuator 20 moves the coin slide 63 rightward. As a result the gumball 21, held in the ready position by the dispensing wall 70, is moved away from the gumball storage wall 74 (FIG. 8). In the meantime, another gumball 21 is prevented from moving through the coin slide gumball aperture 68 by the intrusion of the gate 88 of the base plate 66.

Finally, as seen in FIG. 9, the gumball 21 descends the gumball ramp 48 completely to reach the gumball trough 56 where it is accessible through the gumball access hole 22 for removal from the bank 10. Meanwhile the coin 19 is pushed by the shoulder 80 to a location over the coin aperture 86 in the base plate 66, allowing the coin 44 to fall through to the coin tray 42.

Moving the actuator 20 back to the left moves the coin slide 63 back to its original position (FIG. 7), allows a new gumball 21 to fall through the gumball aperture 68 and locks the slide plate 63 back in its original position until another coin 19 is inserted in the coin slot 18.

Changes and modifications can be made to the particular illustrative embodiment shown here by those skilled in the art without departing from the spirit of the invention, whose scope is defined in the following claims.

We claim:

1. In a coin operated article dispensing device comprising:

base means including article access means, and reservoir means for holding a plurality of articles to be dispensed, mounted on said base means, the improvement comprising a coin operated mechanism that comprises:

base plate means forming a portion of said base means, and slide plate means slidably mounted on said base plate means, slidable between a first, locked, position and a second, dispensing, position said slide plate means including:

article dispensing means for dispensing articles when said slide plate is moved from said first locked position to said second dispensing position means defining an article aperture for passage of articles from said reservoir means to said article dispensing means, a first coin slot portion partially defining a coin receiving slot, including a shoulder portion, and actuator means for slidingly moving said slide plate, said base plate means including:

a second coin slot portion partially defining said coin receiving slot, including a dog means flexibly mounted on said base plate means and arranged to abut said shoulder portion in the absence of a coin in said coin receiving slot and to be displaced from said abutting position by a coin inserted in said slot.

2. The mechanism of claim 1 wherein said base plate means includes a gate portion adapted to intrude in said article aperture when said slide plate is moved from said first, locked position to said second, dispensing, position.

3. The mechanism of claim 1 wherein said shoulder portion includes a coin moving portion and said base plate means includes a portion defining a coin aperture for receiving coins moved by said coin moving portion.

4. The mechanism of claim 1 wherein said article dispensing means comprises wall means mounted on said slide plate means.

5. The mechanism of claim 2 wherein said base means includes a wall portion arranged to cooperate with said wall means to store a said article when said slide plate means is in said first locked position.

6. In a coin operated article dispensing device comprising:

base means including article access means, and reservoir means for holding a plurality of articles to be dispensed, mounted on said base means, the improvement comprising a coin operated mechanism that comprises:

base plate means forming a portion of said base means, and slide plate means slidably mounted on said base plate means, slidable between a first, locked, position and a second, dispensing, position said slide plate means including:

article dispensing means for dispensing articles when said slide plate is moved from said first locked position to said second, dispensing position, said base means including a wall portion arranged to cooperate with said article dispensing wall means to store a said article when said slide plate means is in said first, locked, position, means defining an article aperture for passage of articles from said reservoir means to said article dispensing wall means, a first coin slot portion partially defining a coin receiving slot, including a shoulder portion having a coin moving portion, and actuator means for slidingly moving said slide plate, said base plate means including a second coin slot portion partially defining said coin receiving slot, including a dog means flexibly mounted on said base plate means and arranged to abut said shoulder portion in the absence of a coin in said coin receiving slot and to be displaced from said abutting position by a coin inserted in said slot, and a portion defining a coin aperture for receiving coins moved by said coin moving portion.

* * * * *